US005472185A

United States Patent [19]

Kollann et al.

[11] Patent Number: 5,472,185

[45] Date of Patent: Dec. 5, 1995

[54] SHEET FEEDER AND DIVERTER APPARATUS

[75] Inventors: Rolf Kollann, Herten; Armin Kloke, Düsseldorf, both of Germany

[73] Assignee: Jagenberg Aktiengesellschaft, Dusseldorf, Germany

[21] Appl. No.: 246,609

[22] Filed: May 20, 1994

[30] Foreign Application Priority Data

May 21, 1993 [DE] Germany ..... 43 17 042.0

[51] Int. Cl.[6] ..... B65H 39/10

[52] U.S. Cl. ..... 271/303; 198/367

[58] Field of Search ..... 271/303, 305, 271/297, 225, 184; 198/367, 442

[56] References Cited

U.S. PATENT DOCUMENTS 3,556,518 1/1971 Brockmueller et al. ..... 271/303

3,831,929 8/1974 Hellmer .

5,131,644 7/1992 DuBois ..... 271/303 X

FOREIGN PATENT DOCUMENTS 2922135 12/1979 Germany .

160559 3/1989 Japan ..... 271/303

*Primary Examiner*—David H. Bollinger

*Attorney, Agent, or Firm*—Herbert Dubno

[57] ABSTRACT

A diverter for paper and cardboard sheets has upper and lower guide elements between the incoming conveyor and two outgoing conveyors including an acute angle with one another, constructed so that the upper and lower guide elements are pivoted respectively about horizontal axes above and below the travel path and links are pivotally connected to these guide elements spaced from their pivot axes so that a four-point linkage of the guide elements is provided. The upper guide element is driven by a pivot drive and entrains the lower guide element via the links.

7 Claims, 3 Drawing Sheets

SHEET FEEDER AND DIVERTER APPARATUS

FIELD OF THE INVENTION

The present invention relates to a sheet feeder and diverter apparatus, especially for feeding paper or cardboard (paperboard) sheets from an incoming conveyor to one of two outgoing conveyors including an acute angle between them through a diverter gap between the incoming and outgoing conveyors. More particularly the invention relates to a system of this type in which the diverter includes a gate formed by upper and lower gate elements which are swingable so that the outlet opening of that gate can register respectively with one or the other of the outgoing conveyors to divert the sheets selectively from one to another of them.

BACKGROUND OF THE INVENTION

In the production of sheets of paper or cardboard, a paper or cardboard web may be subdivided by transverse slitting and the like into a succession of sheets which are advanced along respective transport paths and may be stacked at the ends of these paths which can be provided with respective conveyors. In these systems, diverters are frequently provided to allow incoming sheets to be selectively fed along either of two outgoing paths formed by outgoing conveyors including an acute angle between them. The term "conveyor" is here used to refer to a belt system on which the sheets can travel, a surface against which a belt can hold a sheet while entraining it along the respective path, combination of belts, for example, between which the sheets can be displaced or any combination of the above.

The diverter thus can be provided between an incoming conveyor and two outgoing conveyors including an acute angle between them and usually including one or more conveyor belts, the outgoing conveyors generally leading to stacking stations, containers for the sheets or packaging stations in which the sheets can be wrapped or otherwise handled or processed.

German patent publication DE 29 22 135 A1 (corresponding to U.S. Pat. No. 4,195,539 issued 1 Apr. 1980) describes a sheet diverter for sheets of corrugated papers in which two skid-like guide elementa form a gate whose outlet opening is swingable back and forth between the two outgoing stretches. One of the guide elements is an electric guide element fixed on a swingable support to enable machining of the outlet opening to the position of the respective outgoing conveyor by a bending action. A more complex diverter for corrugated sheets is found in U.S. Pat. No. 3,831,929 in which a main path of travel lies in a horizontal plane and flaps are provided for diverting the sheets to either of a pair of secondary travel paths.

By and large, these systems are incapable of providing a problem-free diversion of sensitive sheets of light paper types (area weight<80 g/m$^2$), especially of short sheet lengths (<1000 mm) at high speeds (>200 m/min) and for wide machine widths (>2200 mm). In such cases, a number of problems arise: firstly, the sheets must travel through a narrow gap between the guide surfaces and these surfaces must be flush with the surfaces onto which the sheets are delivered and gaps must be minimized so that the edges of the oncoming sheets do not catch.

Secondly, the guide elements must be sufficiently stiff that they do not vibrate or oscillate upon rapid switching since that can lead to jamming of the sheets in the slot formed between the guide elements.

Finally, for a rapid switchover at high sheet speed, the moment of inertia of the guide elements and the parts which move them must be held to a minimum. All of these requirements can only be satisfied to a limited extent with these earlier systems.

OBJECTS OF THE INVENTION

It is, therefore, the principal object of the present invention to provide an improved diverter for a sheet-feed system of the type described which can operate at high speeds with wide machine widths for a problem-free delivery of comparatively short sheets of light paper types selectively to the outgoing conveyors.

Another object of the invention is to provide an improved sheet feeder and diverter apparatus which is free from the drawbacks of earlier systems as described.

SUMMARY OF THE INVENTION

These objects and others which will become apparent hereinafter are attained, in accordance with the invention, in a pivotal drive which is connected with an upper guide element for swinging the same about the axis fixed on the machine frame and separate from the axis about which the lower guide element is pivotally displaceable. The pivot for the upper guide element lies above the travel plane of the sheet and in the travel direction in a region between the end of the feed part (lower belt) of the incoming conveyor and the end of the free space between the incoming conveyor and the two outgoing conveyors, the two guide elements being interconnected by a link. More particularly, the sheet feeder and diverter apparatus can comprise:

an incoming conveyor for advancing a succession of sheets along a generally horizontal transport path to a downstream end of the conveyor in a direction of travel along the path;

a pair of outgoing conveyors having upstream ends including an acute angle with one another and spaced from the downstream end of the incoming conveyor; and a diverter between the downstream end of the incoming conveyor and the upstream ends of the outgoing conveyors for selectively diverting sheets arriving from the incoming conveyor selectively onto the outgoing conveyors, the diverter comprising:

a lower guide element swingable about a first fixed axis below the path and directly downstream of the incoming conveyor, an upper guide element spaced above the lower guide element, forming a guide gate with the lower guide element through which the sheets pass and having an outlet opening swingable back and forth between the outgoing conveyors, and swingable about a second fixed axis different from the first fixed axis and located above the path and in a region between the downstream end of the incoming conveyor and an ends of a free space between the incoming conveyor and the upstream ends of the outgoing conveyors, a link pivotally connected at a third axis to the upper guide element and a fourth axis to the lower guide element, thereby interconnecting the guide elements for swinging movement, and a pivoting drive connected to the upper guide element for swinging same back and forth about the second axis.

According to a feature of the invention one of the outgoing conveyors is aligned and coplanar with the incoming conveyor in a common horizontal plane therewith, the other of the outgoing conveyors being inclined downwardly from the horizontal plane in the direction at an acute angle thereto, the link being located downstream of the first and second axes in the direction, a distance between the second and third axes being less than a distance between the first and fourth axes.

The upper guide element can be mounted on an underside of a tube rotatable about the second axis and disposed above the path, the tube being operatively connected to the pivoting drive for rotation thereby.

The incoming conveyor can comprise a plurality of mutually parallel belts transversely spaced from one another and passing at the downstream end over a roller, the roller having annular grooves between the belts, guide fingers reaching into the grooves and having upper surfaces parallel to the belts and carrying at ends of the fingers downstream of the grooves, the first axis about which the lower guide element is swingable.

According to the invention, therefore, the two guide elements form a four-pivot linkage with one another, the lever lengths and pivot points being so selected that the outlet opening of the diverter can be exactly aligned with the different inlet openings of the downstream stretches. In addition, the dynamic forces upon switching between the two downstream paths can be significantly reduced because of the separate first and second axes. The sheet diverter can be especially stable over great widths without rendering the moment of inertia too great for rapid back and forth switching at high sheet speeds.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
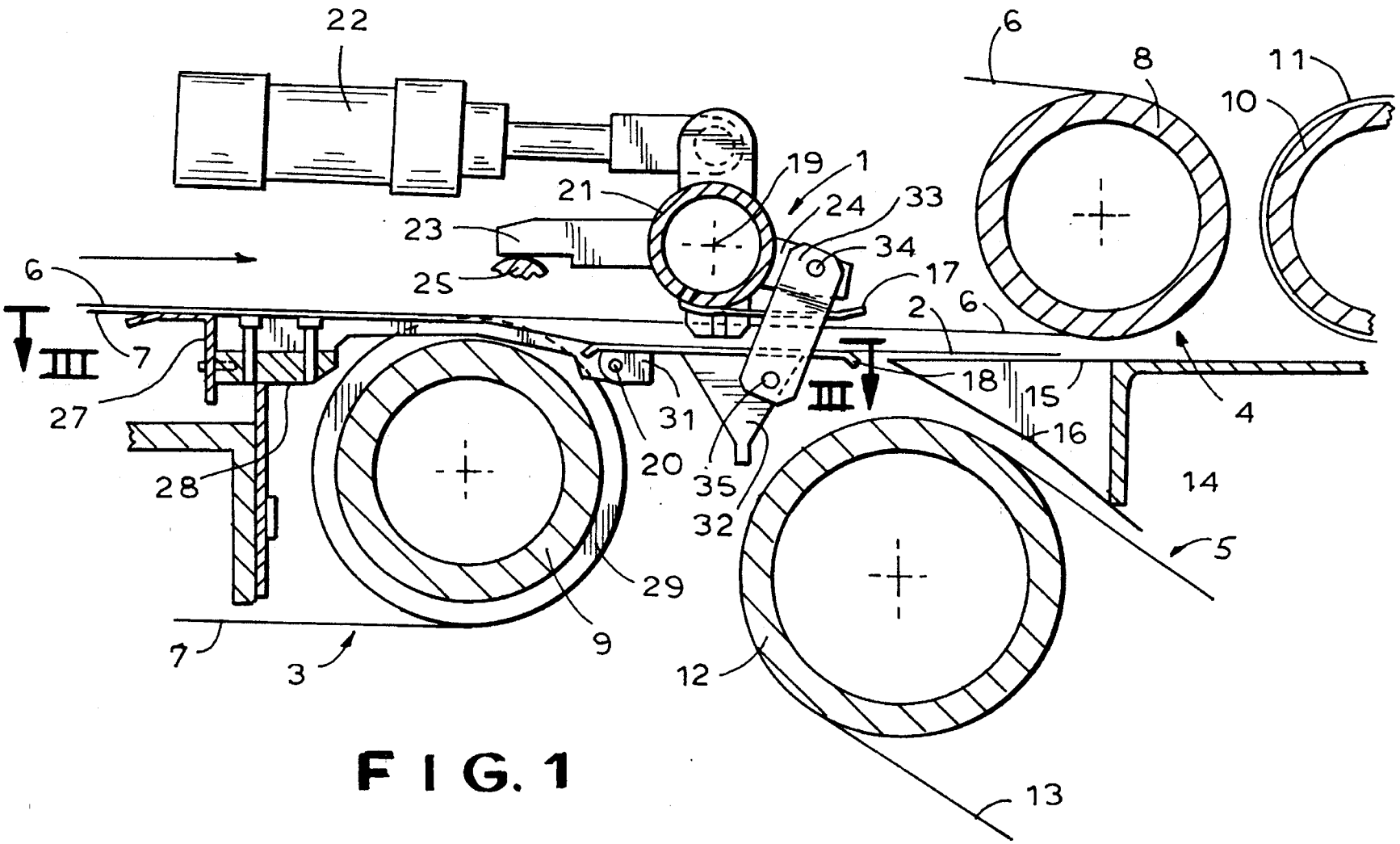
FIG. 1 is a side view in vertical section of a sheet feeder and diverter apparatus in the position of the diverter in which the sheets travel through the diverter without deflection.

The diverter 1 is provided in a cross-cutting machine for the production of paper cardboard or paperboard sheets 2 at a location at the downstream end of an incoming belt conveyor 3 and upstream of two outgoing transport stretches 4, 5. One of these transport paths 4 is horizontally aligned and flush with the travel plane of the sheets 2 from the incoming conveyor 3 and extends the transport path thereof in a straight line to a stacking unit (not shown). The second transport path 5 includes an acute angle to the first path, is inclined downwardly and can serve to discharge sheets 2 or guide them to a second stacking unit.

The incoming belt conveyor 3 has a plurality of transversely-spaced upper belts 6 and transversely-spaced lower belts 7 between which the sheets 2 are entrained. The upper belts pass around a deflection roller 8 downstream of the diverter 1 so that the upper belts 6 extend over the diverter 1 and above the transport path 4.

Both transport paths 4 and 5 are also provided with belt conveyors so that they can also be referred to as outgoing conveyors. The belt conveyor or the horizontal transport path 4 can be seen at its upstream end to comprise a deflection roller 10 around which the upper belts 11 of this outgoing conveyor 4 pass.

The upstream end of the inclined outgoing conveyor 5 is shown to be formed with a deflection roller 12 about which the lower belts 13 pass. At their upstream ends, the two outgoing conveyors or paths 4, 5 are separated by a separating wedge which converges in the direction opposite the direction of travel of the sheets which is from left to right in FIGS. 1 and 2. The table-like upper surface 15 of this wedge forms a lower guide surface for the horizontal outgoing path or conveyor 4 while the inclined lower surface 16 of the wedge forms an upper guide surface for the lower or inclined outgoing conveyor or path 5.

The sheet diverter 1 is comprised of two skid-like guide elements 17, 18 which extend over the full machine width and form a gate for the sheets 2 swingable from a horizontal orientation (FIG. 1) to an inclined orientation (FIG. 2) about respective horizontal axes 19 and 20 which are perpendicular to the sheet travel direction and fixed on the machine frame. These guide elements 17 and 18 are spaced apart by a distance of less than 20 mm. The upper guide element 17 is comprised of respective skids which are disposed in the free spaces between the upper belts 6 and thus are spaced apart across the machine width, i.e. perpendicular to the plane of the paper in FIGS. 1 and 2.

Figure 2:
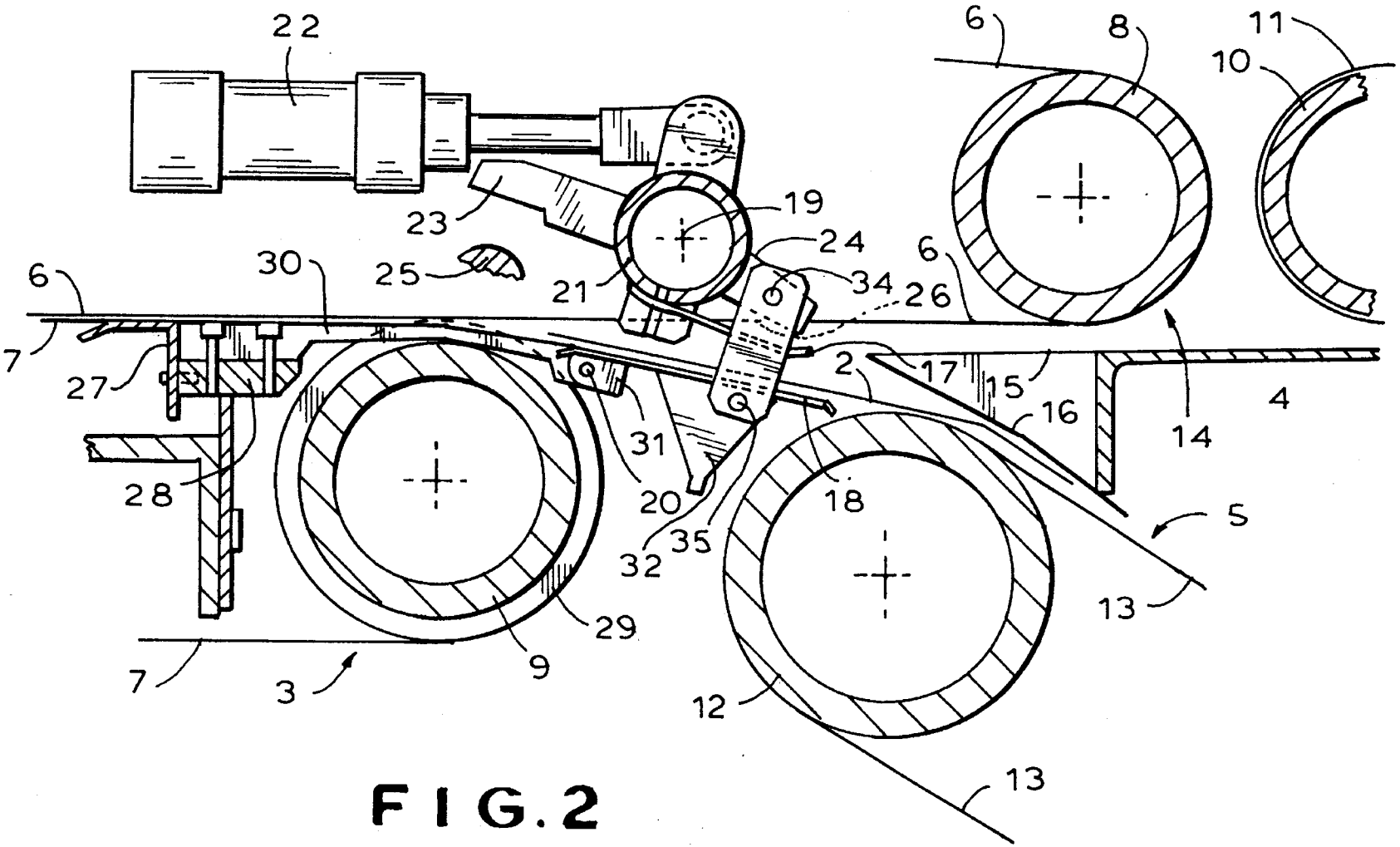
FIG. 2 is a view similar to FIG. 1 showing the diverter deflecting the sheets along the downwardly inclined outgoing conveyor path.
Figure 3:
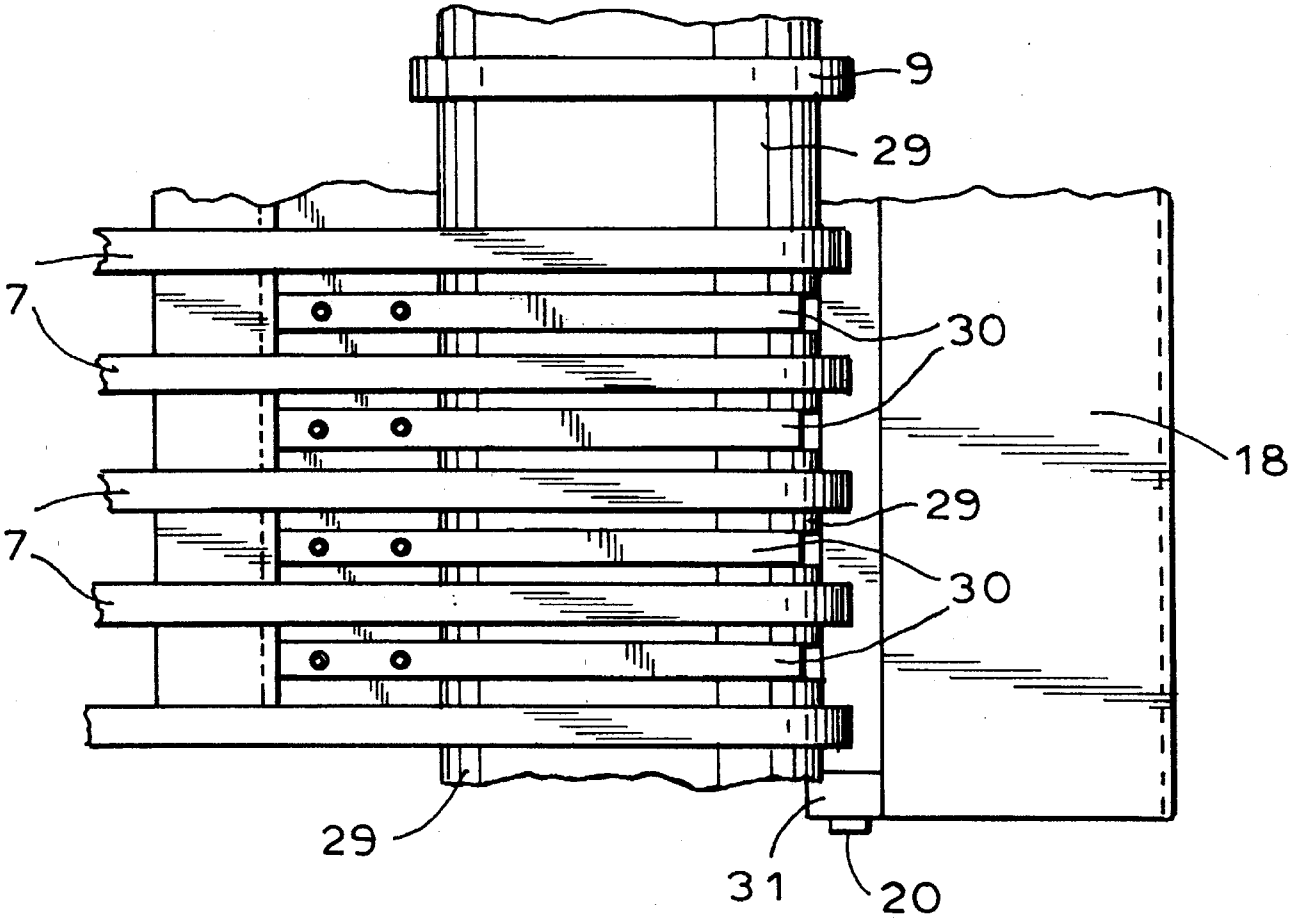
FIG. 3 is a fragmentary plan view taken generally along the line III—III of FIG. 1 showing the spaced-apart belts of the incoming conveyor and the fingers cooperating with the grooved roller thereof.

In the position shown in FIG. 1, these members of the guide element lie parallel to the upper belt 6 at a slight distance above the upper belts 6. They are, however, swingable about the axis 19 until they extend into a position below the upper belt 6 (FIG. 2). In this downwardly swung position, the skids of guide element 17 have their undersides flush with the underside 16 of the wedge 14 and thus guide the sheets 2 into the downwardly inclined outgoing conveyor 5.

The skids of the guide element 17 are fastened in a comb array on the underside of a tube 21 angularly swingable about the axis 19 which is disposed above the travel plane of the sheets 2 and at one of the longitudinal sides of the machine is connected with a piston-and-cylinder unit 22 as a pivoting drive.

To limit the pivotal movement, at both ends of the tube 21, lugs 23 and 24 are provided, the rearwardly-extending lug 23 being capable of engaging in abutment 25 when the upper position of guide element 17 is reached. The forwardly-extending lug 24 can engage an abutment 26 when the tube 21 is swung in the clockwise sense to fix the downwardly-turned position of the diverter in which it delivers the sheets 2 to the lower outgoing conveyor 5.

The pivot axis 19 of the upper guide element 17 is disposed above the travel plane of the sheets in the region between the downstream end of the incoming conveyor 3 formed by the deflection roller 9 and the middle of the free space between the roller 9 and the tube of the wedge 154 so that the guide element 17 in its downwardly swung position (FIG. 2) extends downwardly from the upper belts 6 to about half the free space until it lies in the vicinity of the tip of the wedge 14.

The lower guide element 18 is a single sheet metal skid extending the full width of the machine and at its inlet side is disposed directly downstream of the roller 9 slightly below the travel plane. The guide element 18 is swingable about a pivot axis 20. It forms a lower guide surface bridging between the discharge end of the incoming conveyor 3 at the roller 9 and the outgoing conveyors 4 and 5.

In the upwardly-swung position according to FIG. 1, the guide element 18 extends from the roller 9 substantially to the region of the tip of the wedge 14 and the outlet end of element 18 is located slightly above the surface 15 of wedge 14.

In the downwardly-swung position (FIG. 2) the guide element 18 is substantially tangential to the surface of the deflection roller 12 of the outgoing conveyor 5 and ends with only a slight distance ahead of this roller.

To ensure that the sheets will reliably enter the diverter 1, the lower belt 7 is supported upstream of the roller 9 by a guide table which is fixed on a traverse 28 of the machine frame. Between the spaced apart lower belts 7, the roller 9 is formed with circumferential grooves 29 in which guide fingers 30 of the traverse 28 can lie, the upper surface of these fingers forming a guide surface parallel to the belts 7. Some of the guide fingers 30 can be extended and reach further over the circumference of the roller 9. At their ends, the lower guide element 18 is connected to pivot about the axis 20 by bearing blocks 31 so that a continuous guide surface for the underside of the sheets 2 is formed. Both guide elements 17 and 18 are formed to be very stiff so that they will not vibrate with high switching speeds and so that the sheets 2 will be reliably diverted even at high speeds. For stiffening, the underside of the guide element 18 may be provided with angled sheet metal reinforcement which can be closed at the longitudinal sides of the machine by plates 32. The resulting hollow space can be filled with a foamed synthetic resin.

For joint displacement of the two guide elements 17 and 18, in spite of their spaced-apart pivot axes 19 and 20, by means of the piston-and-cylinder unit 22, at both longitudinal sides of the machine, links 33 are pivotally connected at 34 with lugs 24 and by pivots 35 with the plates 32 so that the pivot axes form four pivot points of a quadrilateral linkage, i.e. a four-point linkage.

The length of the drive lever arm between the pivot points 35 and 34 is smaller than the length of the driven lever arm between pivots 20 and 35. As a result, the outlet opening of the gate formed by the guide elements 17 and 18 will open upon downwardly swinging of the diverter from the outgoing conveyor 4 to the outgoing conveyor 5 and can match exactly the opening between the guide surface 16 and the roller 12 to ensure reliable passage of the sheets through these openings.

Upon the return swing to again convey the sheets 2 on to the travel path 4, the outlet opening between the guide plates 17 and 18 is again reduced to match the inlet opening to the guide path 4. In both cases, therefore, the opening of the gate is matched to the guide paths with which that gate is aligned.

We claim:

1. A sheet feeder and diverter apparatus, comprising:

an incoming conveyor for advancing a succession of sheets along a generally horizontal transport path to a downstream end of said conveyor in a direction of travel along said path;

a pair of outgoing conveyors having upstream ends including an acute angle with one another and spaced from said downstream end of said incoming conveyor; and a diverter between said downstream end of said incoming conveyor and said upstream ends of said outgoing conveyors for selectively diverting sheets arriving from said incoming conveyor selectively onto said outgoing conveyors, said diverter comprising:

a lower guide element swingable about a first fixed axis below said path and directly downstream of said incoming conveyor, an upper guide element spaced above said lower guide element and forming a guide gate with said lower guide element through which said sheets pass, said guide gate having an outlet opening swingable back and forth between said outgoing conveyors, said upper guide element being swingable about a second fixed axis different from said first fixed axis and located above said path and in a region between said downstream end of said incoming conveyor and an ends of a free space between said incoming conveyor and said upstream ends of said outgoing conveyors, a member connected to said upper guide element, a link pivotally connected at a third axis to said member and at a fourth axis to said lower guide element, thereby interconnecting said guide elements for swinging movement, and a pivoting drive connected to said member for swinging said upper guide element back and forth about said second axis.

2. The sheet feeder and diverter apparatus defined in claim 1 wherein one of said outgoing conveyors is aligned and coplanar with said incoming conveyor in a common horizontal plane therewith, the other of said outgoing conveyors being inclined downwardly from said horizontal plane in said direction at an acute angle thereto, said link being located downstream of said first and second axes in said direction, a distance between said second and third axes being less than a distance between said first and fourth axes.

3. The sheet feeder and diverter apparatus defined in claim 2 wherein said upper guide element is mounted on an underside of a tube forming said member and rotatable about said second axis and disposed above said path, said tube being operatively connected to said pivoting drive for rotation thereby.

4. The sheet feeder and diverter apparatus defined in claim 3 wherein said incoming conveyor comprises a plurality of mutually parallel belts transversely spaced from one another and passing at said downstream end over a roller, said roller having annular grooves between said belts, guide fingers reaching into said grooves and having upper surfaces parallel to said belts and carrying at ends of said fingers downstream of said grooves, said first axis about which said lower guide element is swingable.

5. The sheet feeder and diverter apparatus defined in claim 1 wherein said upper guide element is mounted on an underside of a tube forming said member and rotatable about said second axis and disposed above said path, said tube being operatively connected to said pivoting drive for rotation thereby.

6. The sheet feeder and diverter apparatus defined in claim 5 wherein said incoming conveyor comprises a plurality of mutually parallel belts transversely spaced from one another and passing at said downstream end over a roller, said roller having annular grooves between said belts, guide fingers reaching into said grooves and having upper surfaces parallel to said belts and carrying at ends of said fingers downstream of said grooves, said first axis about which said lower guide element is swingable.

7. The sheet feeder and diverter apparatus defined in claim 1 wherein said incoming conveyor comprises a plurality of mutually parallel belts transversely spaced from one another and passing at said downstream end over a roller, said roller having annular grooves between said belts, guide fingers reaching into said grooves and having upper surfaces parallel to said belts and carrying at ends of said fingers downstream of said grooves, said first axis about which said lower guide element is swingable.

* * * * *